US005655914A

United States Patent [19]

McCartin et al.

[11] Patent Number: 5,655,914

[45] Date of Patent: Aug. 12, 1997

[54] CONNECTOR HAVING PRESS FIT MATING SHROUDS

[75] Inventors: Doug E. McCartin, Henryville, Ind.; John K. Hynes, Louisville, Ky.; Brian A. Striegel, New Albany, Ind.

[73] Assignee: Samtec, Inc., New Albany, Ind.

[21] Appl. No.: 479,127

[22] Filed: Jun. 7, 1995

[51] Int. Cl.[6] ..... H01R 9/09

[52] U.S. Cl. ..... 439/78; 439/374; 439/79

[58] Field of Search ..... 439/78, 246, 247, 439/248, 540, 374, 378, 717, 677, 680, 79

[56] References Cited

U.S. PATENT DOCUMENTS

| | | | |
|---|---|---|---|
| 4,173,387 | 11/1979 | Zell . | |
| 4,603,930 | 8/1986 | Ito . | |
| 4,761,141 | 8/1988 | Hawk et al. | 439/153 |
| 4,871,320 | 10/1989 | Mouissie | 439/78 |
| 4,978,308 | 12/1990 | Kaufman | 439/83 |
| 4,998,887 | 3/1991 | Kaufman et al. | 439/78 |
| 5,037,323 | 8/1991 | Locati | 439/374 |
| 5,129,831 | 7/1992 | Locati | 439/79 |
| 5,147,226 | 9/1992 | Kile | 439/680 |
| 5,161,996 | 11/1992 | Locati | 439/374 |
| 5,180,312 | 1/1993 | Martin | 439/78 |
| 5,199,880 | 4/1993 | Arai | 439/78 X |
| 5,261,827 | 11/1993 | Lenzi et al. | 439/78 |

*Primary Examiner*—Allan N. Shoap
*Assistant Examiner*—Christopher J. McDonald
*Attorney, Agent, or Firm*—Woodard, Emhardt, Naughton, Moriarty & McNett

[57] ABSTRACT

Connectors having press fit mating shrouds. The connectors are formed from long strips of pin headers, which are cut to a length equal to the desired number of connector positions plus four additional positions. A pre-molded shroud is then press fit to each end of the cut pin header. The pre-molded shrouds include vertical holes which are sized to fit snugly over the pins on the end position of the cut pin header in order to remain in place after placement. Additionally, the shrouds include vertical slots which snugly receive the pins on the second-to-last position on each end of the pin header. Because the last two positions on each end of the cut pin header are covered by the shrouds, the completed connector includes the desired number of connector positions. Furthermore, the only items that must be inventoried are the long strips of pin headers and the pre-molded shrouds. Any desired size of connector may be formed from these two components.

16 Claims, 4 Drawing Sheets

CONNECTOR HAVING PRESS FIT MATING SHROUDS

TECHNICAL FIELD OF THE INVENTION

The present invention relates generally to electrical connectors and, more particularly, to a connector having press fit mating shrouds.

BACKGROUND OF THE INVENTION

Many electrical connectors are in the form of pin headers. The pin header contains a pin field which is mounted to the body of the header and each of the pins of the pin field are soldered to an electrical circuit board using either surface mount techniques or pin through-holes. The pin header is designed to receive a complementary mating connector which is typically terminated in a socket.

It is typically desirable that the pin header include a housing, or shroud, which extends above the height of the pin field. This is because such connectors are often "blind mated", which refers to the fact that the two connector halves are not always directly visible to the person mating them together. Blind mating is not practical if there is no shroud structure to provide guidance to the complementary mating connector. When blind mating a complementary connector to such a pin header without a shroud, there is no structure on the pin header to assure that the pins in the pin header and the receptacle contacts in the complementary mating connector are aligned before mating forces are applied. This can be potentially damaging, resulting in bent pins or misaligned connectors. Upon unmating a mated complementary connector from such an unshrouded pin header, there is nothing to prevent the mating connector from being tilted and thus removed in an arc rather than being removed parallel to the direction of the pins. Such an arcuate removal path, known as peeling, can also result in bent pins.

Therefore, connectors are often formed with integral housings which form a shroud that completely, or substantially completely, surrounds the pin field and extends to a height that is above the height of the pin field. Such a shroud guides the mating connector into alignment with the pin field before mating pressures are applied between the two connector halves. This presents a problem, however, in that the connectors are formed in many different sizes, each size having a specified number of pins in the pin field. Because such connectors are formed with a housing shroud encircling the pin field, it is necessary to keep an inventory of each connector size in stock, greatly increasing the inventory carrying costs. If the integral housing shroud were not required, the pin fields could be stocked in long strips and merely "cut to position" (i.e. cut to the desired length for the connector size required), as is presently done with unshrouded connectors. This would greatly decrease the inventory carrying costs because separate connector sizes would not have to be carried in inventory.

There is therefore a need in the connector industry for a way to provide shrouded connectors without requiting that many sizes of connectors be carried in inventory. The present invention is directed toward meeting this need.

SUMMARY OF THE INVENTION

The present invention relates to connectors having press fit mating shrouds. The connectors are formed from long strips of pin headers, which are cut to a length equal to the desired number of connector positions plus four additional positions. A pre-molded shroud is then press fit to each end of the cut pin header. The pre-molded shrouds include vertical holes which are sized to fit snugly over the pins on the end position of the cut pin header in order to remain in place after placement. Additionally, the shrouds include vertical slots which snugly receive the pins on the second-to-last position on each end of the pin header. Because the last two positions on each end of the cut pin header are covered by the shrouds, the completed connector includes the desired number of connector positions. Furthermore, the only items that must be inventoried are the long strips of pin headers and the pre-molded shrouds. Any desired size of connector may be formed from these two components.

In one form of the invention an electrical connector having a first number of positions is disclosed, comprising a pin header having a second number of positions, wherein the second number of positions comprises the first number of positions, a first extra position, a second extra position, a third extra position and a fourth extra position; a first shroud coupled to the pin header and engaging first pins at the first and second extra positions; and a second shroud coupled to the pin header and engaging second pins at the third and fourth extra positions.

In another form of the invention a shroud adapted for coupling to a pin header is disclosed, the shroud comprising a shroud body having a substantially C-shaped configuration and including a top surface, a bottom surface, a first end surface, a second end surface, a first side wall and a second side wall, wherein the first and second side walls extend from the first end surface to a plane beyond the second end surface; and a plurality of vertical holes formed in the shroud body, wherein the vertical holes are sized to receive pins of an end position of the pin header in order to couple the shroud to the pin header.

In another form of the invention a method of forming an electrical connector having a first number of positions, comprising the steps of: (a) providing a pin header having a second number of positions, wherein the second number of positions comprises the first number of positions, a first extra position, a second extra position, a third extra position and a fourth extra position; (b) coupling a first shroud to the pin header, wherein the first shroud engages first pins at the first and second extra positions; and (c) coupling a second shroud to the pin header, wherein the second shroud engages second pins at the third and fourth extra positions.

DESCRIPTION OF THE PREFERRED EMBODIMENT

Figure 1:
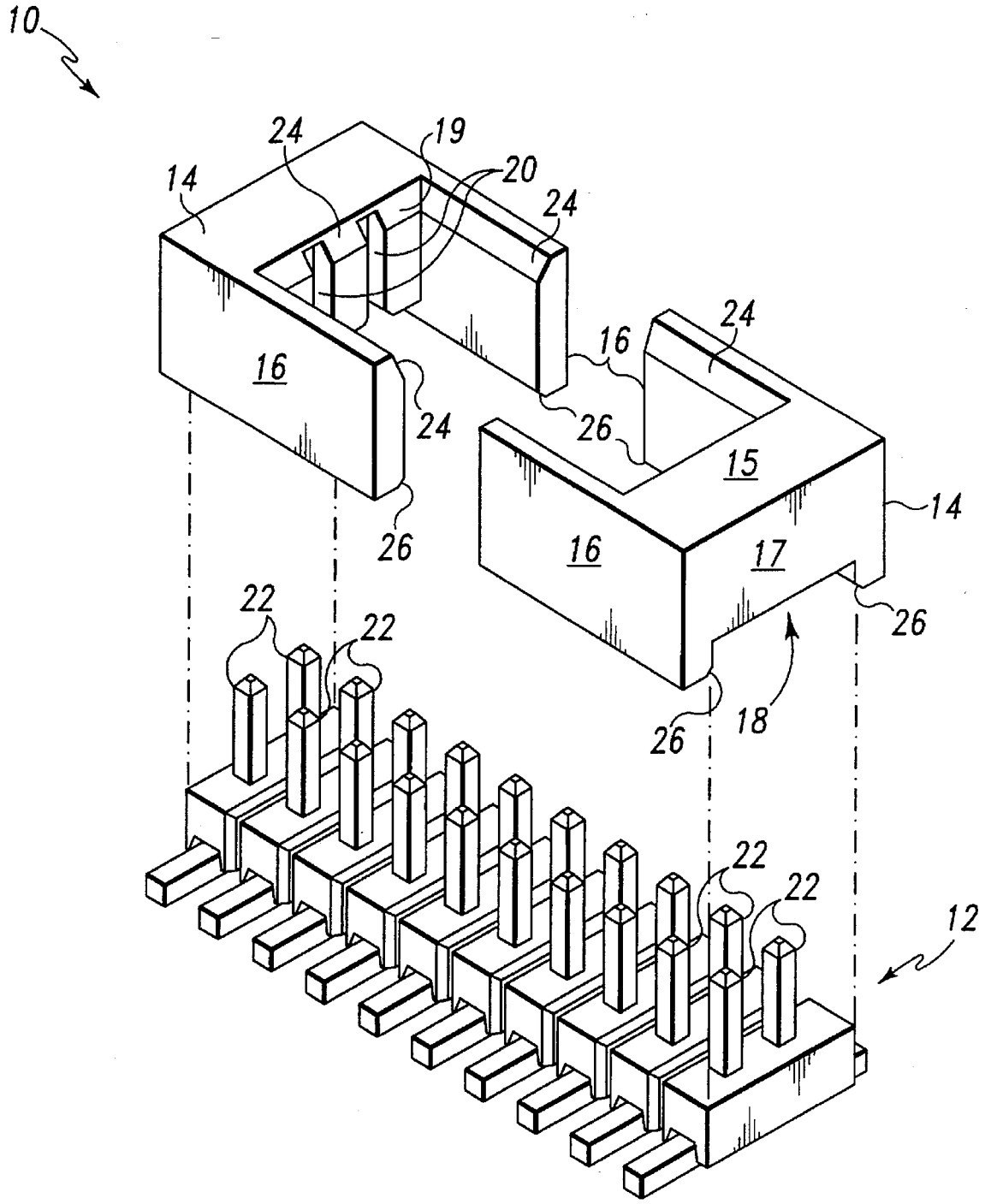
FIG. 1 is an isometric exploded view of a first embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention allows shrouded connectors of any number of pin positions to be formed without requiring that each of the separately sized connectors be carried in inventory. Referring to FIG. 1, there is illustrated an exploded perspective view of a first embodiment shrouded connector of the present invention, indicated generally at 10. The connector 10 is formed from a pin header 12 which has four extra positions (i.e. eight more pins for a two row connector) beyond the number of positions required for the completed connector. The pin header 12 illustrated in FIG. 1 is of the surface mount variety, however it will be appreciated by those skilled in the art that the concepts of the present invention are equally applicable to connectors which are mounted with through-holes. The pin header 12 is cut from a longer pin header strip at the time that it is desired to form the connector. The pin header 12 is cut from one of these longer strips to a length which includes four more positions than is required for the finished connector. Because of this, it is only necessary for the connector manufacturer to inventory the long pin header strips. For example, only pin header strips having 50 positions could be inventoried, thereby allowing the manufacture of connectors in any size from 46 positions and smaller.

The connector shroud is formed by fitting two separately molded shrouds 14 to opposite ends of the pin header 12. The molded shrouds 14 are identical in configuration no matter what size connector is being assembled. It is therefore possible to produce the shrouds 14 in large quantifies and carry only a single size in inventory. As a result, any size connector may be manufactured using only two inventoried parts: the long pin header and the shrouds 14.

Each of the shrouds 14 include a top surface 15, a first end surface 17, a bottom surface 18, a second end surface 19 and side walls 16 which extend partially toward the center of the connector 10. The separation between the inside surfaces of opposing side walls 16 is formed to be just slightly larger than the outside dimension of the pin header 12 so that the shrouds 14 will be snugly received upon the pin header 12. The side walls 16 extend down below the bottom surface 18 of the shroud body so that the side walls 16 may wrap around the base of the pin header 12 when the shroud 14 is firmly seated thereon.

Figure 5:
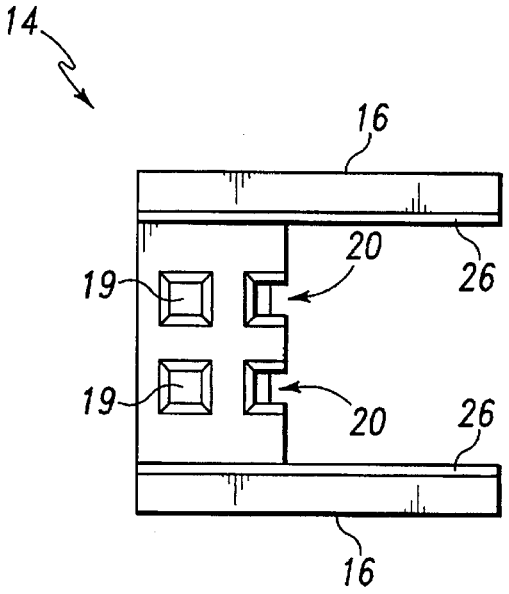
FIG. 5 is a bottom plan view of the first embodiment mating shroud of the present invention.

Each of the shrouds 14 include two vertical holes 19 (see FIG. 5) and two vertical channels 20 formed in the main body of the shroud 14. The vertical holes 19 and channels 20 are sized and positioned such that they receive the four pins on the end position of the pin header 12 when the shroud 14 is mated with the end of the pin header 12. The dimensions of the shroud 14 are such that the tight fit between the vertical holes 19 and channels 20 and the end position pins 22, as well as the fight fit between the end walls 16 and the body of the pin header 12, provide a secure mating between the shroud 14 and the pin header 12. It is therefore only necessary to press a shroud 14 onto each end of the pin header 12 in order to assemble the finished connector 10. No other coupling between the shroud 14 and the pin header 12 is required, although further coupling means may be added for added security against future inadvertent disassembly.

The upper inside edges of the shrouds 14 include beveled surfaces 24 which facilitate to guide the mating complementary connector into proper alignment with the pin header 12 during subsequent connector blind mating. Additionally, the bottom inside edges of the side walls 16 include beveled edges 26 which facilitate proper alignment between the shrouds 14 and the pin header 12 during assembly of the connector 10.

Figure 2:
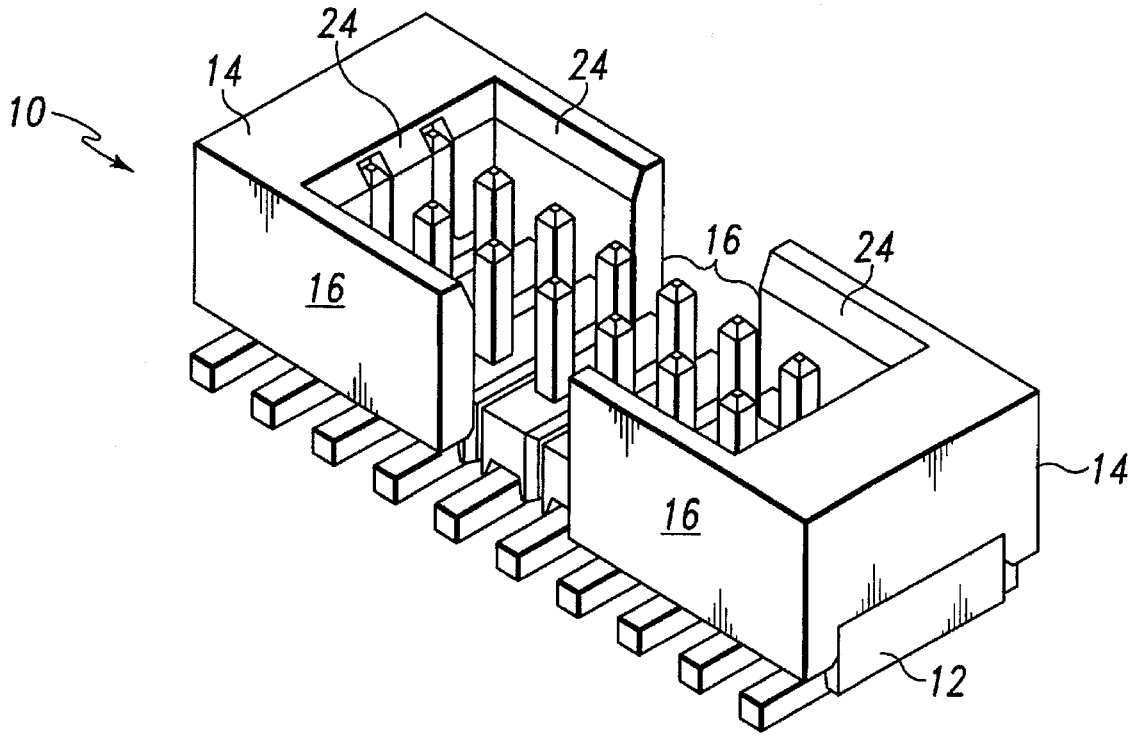
FIG. 2 is an isometric view of the first embodiment of the present invention.

The assembled connector 10 is illustrated in FIG. 2, wherein a pair of shrouds 14 have been assembled to the end positions of the pin header 12. It will be appreciated by those skilled in the art that the pin header 12 must be cut to include four extra positions in order to account for the fact that the shrouds 14 substantially cover the two end positions on each end of the connector 10, rendering these end positions unusable for connector mating purposes.

Figure 3:
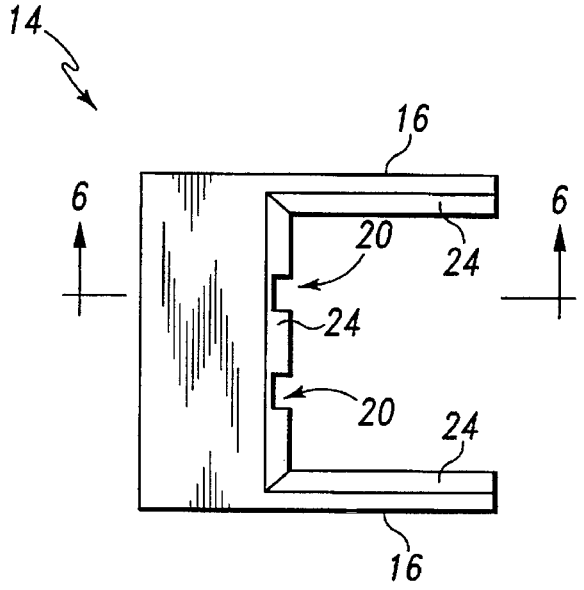
FIG. 3 is a top plan view of the first embodiment mating shroud of the present invention.

Referring now to FIG. 3, the shroud 14 of the present invention is illustrated in a top plan view. From this perspective, it can be seen that the beveled surfaces 24, which are disposed on all of the inside top edges of the shroud 14, will greatly facilitate the guiding of the mating complementary connector into proper alignment with the pins on the pin header 12. This substantially eliminates the risk of bent pins due to misalignment of the connector halves during blind mating.

Figure 4:
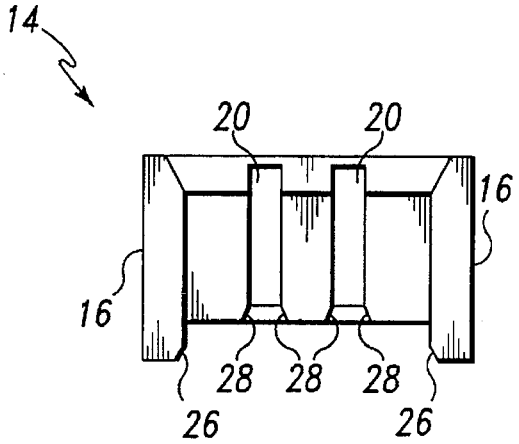
FIG. 4 is an elevational view of the first embodiment mating shroud of the present invention.

The shroud 14 of the present invention is illustrated in a first end elevational view in FIG. 4. The view of FIG. 4 is of the interior of the shroud 14 and the vertical slots 20 which mate with the pins of the second-to-end position of the pin header 12 are clearly visible. The bottom edges of the vertical holes 19 and slots 20 include beveled surfaces 28 which facilitate the proper orientation of the shroud 14 to the pins 22 on the two end positions of the pin header 12.

Figure 6:
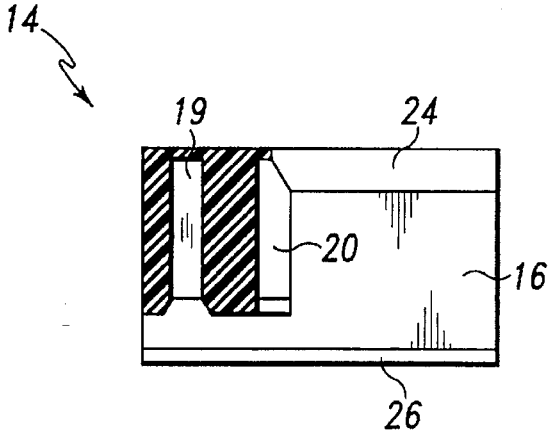
FIG. 6 is a cross-sectional view of the first embodiment mating shroud of the present invention.

This helps to ensure that the end position pins 22 are not bent during assembly of the shroud 14 onto the pin header 12. The beveled edges 26 on the bottoms of the side walls 16 also assist in proper orientation of the shroud 14 with respect to the pin header 12 during mating of these two portions. A bottom plan view of the shroud 14 is illustrated in the FIG. 5, in which the vertical holes 19 are visible. FIG. 6 illustrates a cross-sectional view of the first embodiment mating shroud of the present invention.

It will be appreciated by those skilled in the art that by incorporating the teachings of the present invention, any sized shrouded connector may be formed from only two inventoried parts. The first inventoried part is a long pin header, which contains 50 positions (i.e. 100 pins for a two row connector) in a preferred embodiment. The second inventoried part is the blind mating shroud 14. Two shrouds 14 are used in the formation of each connector 10 of the present invention. The long pin header strips are cut to position when it is determined what size connector is required. For example, if a 20 position connector is required, one of the long pin header strips from inventory is cut to 24 positions. A pair of molded shrouds 14 are then fit to the pin header such that each shroud 14 covers the pins 22 on each of the extra end positions. Once assembled, the shrouds 14 provide adequate blind mating assist during subsequent blind mating of the assembled connector 10 with a complementary mating connector. Because the pin header 12 of the connector 10 must be cut to position with four extra positions than are required for the finished connector, inventorying long pin header strips of 50 positions will allow any connector size having 46 positions or less to be manufactured. Obviously, long pin header strips having more or fewer positions could be carried in inventory in order to facilitate formation of connectors of various ranges of positions.

In a preferred embodiment of the present invention, the press fit shrouds 14 are injection molded plastic and are formed by injection molding processes which are notoriously well known in the art. The pin header strips which are used in the present invention are of the type commonly used in the connector industry.

Figure 7:
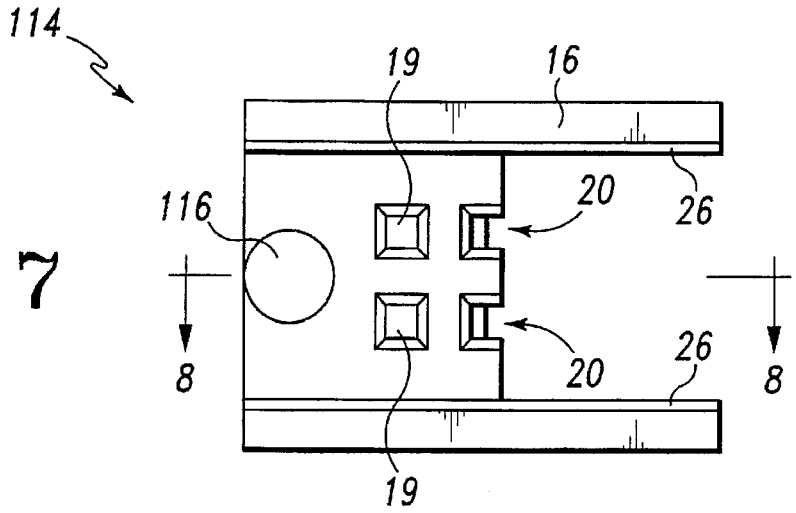
FIG. 7 is a bottom plan view of a second embodiment mating shroud of the present invention.
Figure 8:
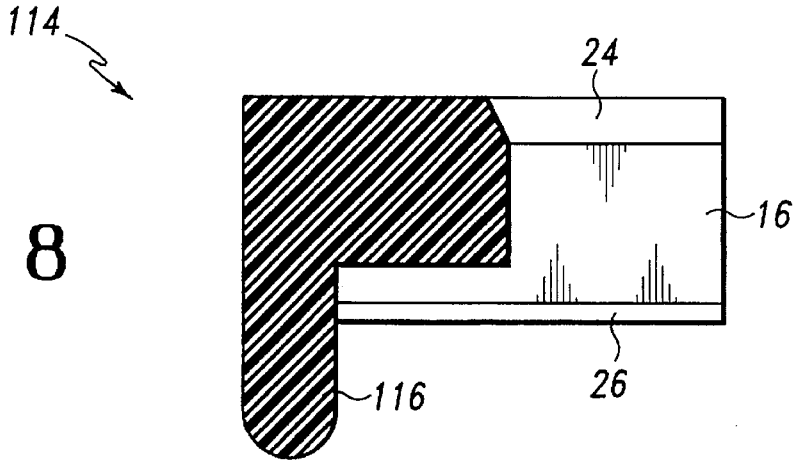
FIG. 8 is a cross-sectional view of the second embodiment mating shroud of the present invention.
Figure 9:
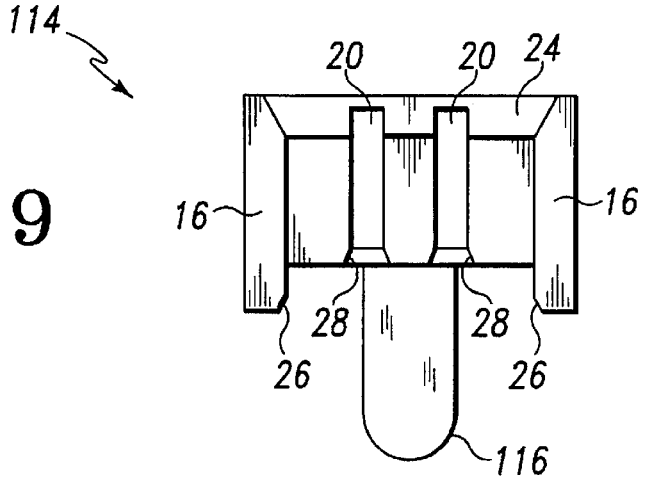
FIG. 9 is an end elevational view of the second embodiment mating shroud of the present invention.

Referring now to FIG. 7, there is illustrated a second embodiment mating shroud of the present invention, indicated generally at 114. The shroud 114 is substantially identical to the shroud 14 with the exception that the shroud 114 includes an alignment pin 116 integrally molded therewith. The alignment pin 116 is adapted to mate with an alignment hole in the circuit board holding the shrouded connector. The mating of the alignment pin 116 with such a mating hole ensures alignment of the connector pins with their respective solder pads or through holes on the circuit board. The shroud 114 is illustrated in cross section in FIG. 8 and in an end elevational view in FIG. 9.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An electrical connector having a first number of positions, comprising:

a pin header having a second number of positions, wherein the second number of positions comprises the first number of positions, a first extra position, and a second extra position, a third extra position and a fourth extra position;

a first shroud coupled to the pin header and engaging first pins at the first and second extra positions;

wherein the first shroud engages the first pins with a first plurality of vertical holes and a second plurality of vertical slots formed in the first shroud; and a second shroud coupled to the pin header and engaging second pins at the third and fourth extra positions;

wherein the second shroud engages the second pins with a third plurality of vertical holes and a fourth plurality of vertical slots formed in the second shroud.

2. The electrical connector of claim 1, wherein the pin header is of a surface mount configuration.

3. The electrical connector of claim 1, wherein the first shroud substantially covers the first and second extra positions and the second shroud substantially covers the second and third extra positions.

4. The electrical connector of claim 1, wherein the first and second shrouds are substantially identical.

5. The electrical connector of claim 1, wherein:

the first shroud includes first side walls which extend beyond the first and second extra positions; and the second shroud includes second side walls which extend beyond the second and third extra positions.

6. The electrical connector of claim 1, wherein:

the first shroud includes a first beveled top surface; and the second shroud includes a second beveled top surface.

7. A shroud adapted for coupling to a pin header, the shroud comprising:

a shroud body having a substantially C-shaped configuration and including:

a top surface;

a bottom surface substantially parallel to the top surface;

a first end surface substantially perpendicular to the top surface:

a second end surface substantially parallel to the first end surface;

a first side wall extending vertically from the top surface to the bottom surface and horizontally from the first end surface to a plane beyond the second end surface; and a second side wall extending vertically from the top surface to the bottom surface and horizontally from the first end surface to the plane beyond the second end surface and a plurality of vertical holes formed in the shroud body from the bottom surface toward the top surface;

wherein the vertical holes are sized to receive first pins of an end position of the pin header in order to couple the shroud to the pin header; and wherein the first and second side walls and the second end surface are operative to guide a mating connector into alignment with second pins of the pin header during blind mating of the connector with the pin header.

8. The shroud of claim 7, wherein the first and second side walls extend from the top surface to a plane beyond the bottom surface.

9. The shroud of claim 8, wherein a first distance between the first and second side walls is sized to receive the pin header therebetween.

10. The shroud of claim 9, wherein a first bottom inside edge of the first side wall and a second bottom inside edge of the second side wall are beveled.

11. The shroud of claim 7, wherein upper inside edges of the shroud are beveled.

12. The shroud of claim 7, wherein the shroud is constructed of injection molded plastic.

13. A shroud adapted for coupling to a pin header, the shroud comprising:

a shroud body having a substantially C-shaped configuration and including a top surface, a bottom surface, a first end surface, a second end surface, a first side wall, and a second side wall, wherein the first and second side walls extend from the first end surface to a plane beyond the second end surface;

a plurality of vertical holes formed in the shroud body, wherein the vertical holes are sized to receive pins of an end position of the pin header in order to couple the shroud to the pin header; and a plurality of vertical slots formed in the shroud body, wherein the vertical slots are sized to receive pins of a second-to-end position of the pin header in order to couple the shroud to the pin header.

14. A method of forming an electrical connector having a first number of positions, comprising the steps of:

(a) providing a pin header having a second number of positions, wherein the second number of positions comprises the first number of positions, a first extra position, a second extra position, a third extra position and a fourth extra position;

(b) coupling a first shroud to the pin header, wherein the first shroud includes first vertical holes to engage first pins at the first extra position and first vertical slots to engage second pins at the second extra position; and (c) coupling a second shroud to the pin header, wherein the second shroud includes second vertical holes to engage third pins at the third extra position and second vertical slots to engage fourth pins at the fourth extra position.

15. The method of claim 14, wherein step (b) comprises engaging the first pins with first vertical holes formed in the first shroud.

16. The method of claim 15, wherein step (c) comprises engaging the second pins with second vertical holes formed in the second shroud.

* * * * *

UNITED STATES PATENT AND TRADEMARK OFFICE

CERTIFICATE OF CORRECTION

PATENT NO. : 5,655,914

DATED : August 12, 1997

INVENTOR(S) : Doug E. McCartin, John K. Hynes & Brian A. Striegel

It is certified that error appears in the above-indentified patent and that said Letters Patent is hereby corrected as shown below:

In column 1, line 59, please change "requiting" to --requiring--.

In column 3, line 40, please change "quantifies" to --quantities--.

Signed and Sealed this

Twenty-eighth Day of October, 1997

*Attest:*

*Attesting Officer*

BRUCE LEHMAN

*Commissioner of Patents and Trademarks*